US007481005B2

(12) United States Patent
Bolduan et al.

(10) Patent No.: US 7,481,005 B2
(45) Date of Patent: Jan. 27, 2009

(54) METHOD AND CONFIGURATION FOR REMOVING MOISTURE FROM ITEMS OF CLOTHING

(75) Inventors: Edwin Bolduan, Berlin (DE); Wolfgang Proppe, Berlin (DE)

(73) Assignee: BSH Bosch und Siemens Haugeraete GmbH, Munich (DE)

( * ) Notice: Subject to any disclaimer, the term of this patent is extended or adjusted under 35 U.S.C. 154(b) by 370 days.

(21) Appl. No.: 10/608,571

(22) Filed: Jun. 27, 2003

(65) Prior Publication Data

US 2003/0233766 A1 Dec. 25, 2003

Related U.S. Application Data

(63) Continuation of application No. PCT/EP01/14909, filed on Dec. 17, 2001.

(30) Foreign Application Priority Data

Dec. 27, 2000 (DE) ..... 100 65 334
Dec. 27, 2000 (DE) ..... 100 65 335
Dec. 27, 2000 (DE) ..... 100 65 336

(51) Int. Cl.
*F26B 3/00* (2006.01)

(52) U.S. Cl. ..... 34/95; 34/95.3

(58) Field of Classification Search ..... 34/335, 34/336, 95, 95.3, 397, 399
See application file for complete search history.

(56) References Cited

U.S. PATENT DOCUMENTS 1,773,167 A * 8/1930 Bronander ..... 26/27
2,817,227 A * 12/1957 Eriksson ..... 68/20
3,592,585 A * 7/1971 Candor et al. ..... 34/631
4,592,497 A * 6/1986 Georges ..... 34/104
5,404,848 A * 4/1995 Nelson ..... 123/198 E
5,953,938 A * 9/1999 Tung et al. ..... 68/5 D
6,473,998 B1 * 11/2002 Henry et al. ..... 34/629
6,722,053 B2 * 4/2004 Henry et al. ..... 34/69
2004/0000068 A1 * 1/2004 Bolduan et al. ..... 34/487

FOREIGN PATENT DOCUMENTS

DE 2 035 540 1/1972
JP 61007100 A * 1/1986
JP 06-126098 5/1994
JP 06126098 A 5/1994
JP 08-049161 2/1996
JP 08049161 A * 2/1996

* cited by examiner

*Primary Examiner*—Jiping Lu
(74) *Attorney, Agent, or Firm*—Russell W. Warnock; James E. Howard

(57) ABSTRACT

Examples of dehumidifying processes for clothes include spinning, extracting the moisture by pressure, or drying the clothes using heat and air. To dehumidify the clothes gently and economically in terms of energy consumption, a method and apparatus for dehumidifying clothes includes bringing the clothes into contact with at least one absorption body of an absorbent material. Advantageously, a rotating absorbent body is used, its sections being continuously alternately brought into contact with an item of clothing and dehumidified by pressing.

8 Claims, 1 Drawing Sheet

METHOD AND CONFIGURATION FOR REMOVING MOISTURE FROM ITEMS OF CLOTHING

CROSS-REFERENCE TO RELATED APPLICATION

This application is a continuation of copending International Application No. PCT/EP01/14909, filed Dec. 17, 2001, which designated the United States and was not published in English.

BACKGROUND OF THE INVENTION

Field of the Invention

The invention relates to a method and a configuration for removing moisture from items of clothing.

Numerous methods of, and configurations for, removing moisture from items of clothing are known. For example, it is known for items of clothing that are to have moisture removed from them to be centrifuged, in particular, in a drum provided with openings, in order for liquid absorbed by the items of clothing to be separated off. It is also known for liquid to be squeezed out of items of clothing. These known methods, however, have the disadvantage that the fabric of the items of clothing is badly creased, which renders subsequent pressing or ironing more difficult. It is additionally known for wet items of clothing to have moisture removed from them, and/or to be dried, by hot air, although this, disadvantageously, requires a large amount of energy.

SUMMARY OF THE INVENTION

It is accordingly an object of the invention to provide a method and configuration for removing moisture from items of clothing that overcome the hereinafore-mentioned disadvantages of the heretofore-known devices and methods of this general type and that, with low energy-related outlay, extracts moisture from the items of clothing without the latter suffering any adverse effects.

With the foregoing and other objects in view, there is provided, in accordance with the invention, a method of removing moisture from items of clothing, including the steps of bringing an item of clothing into contact with at least one absorbent body made of an absorbent material and subsequently separated the item of clothing from the at least one absorbent body.

Using an absorbent material allows moisture to be extracted from the item of clothing with low energy-related outlay. A suitable configuration of the absorbent body here means that the item of clothing is not adversely affected. This is particularly easy because absorbent materials for producing the absorbent body are generally soft in any case so they do not adversely affect the item of clothing. As such, there are no impressions produced in the item of clothing and there is only a small amount of creasing, if any at all. Subsequent pressing is, thus, simplified to a considerable extent. If the absorbent body is made of a hard material, the surface that is brought into contact with the item of clothing can be configured in a smooth manner.

The absorbent body may be made, for example, of foam that has cells into which liquid from the item of clothing is drawn on account of the capillary action. It is also possible for the absorbent body to be made of a woven fabric or of a nonwoven or felt material made of fibers, in particular, microfibers.

An absorbent body made of a woven fabric may have additional absorbency-increasing fibers that, for example, are applied by flock coating or are worked therein in the form of loops. An example of a woven fabric provided with loops is terry cloth, it also being possible to use Turkey toweling in which the loops have been cut open. The absorbent body, advantageously, contains hydrophilic materials. In particular, in the case of fibers, the latter may be, for example, cotton or polyamide fibers.

The moisture that is to be removed may be, in particular, washing liquid or rinsing liquid for rinsing out washing liquid, these being used during washing of the items of clothing.

In accordance with another mode of the invention, following contact with the item of clothing, the absorbent body has moisture removed from it and/or is dried. As a result of the previous transfer of the moisture from the item of clothing to the absorbent body and the removal of moisture from the absorbent body rather than the item of clothing, it is possible to use numerous advantageous moisture-removal methods because the item of clothing need not be taken into consideration.

For the purpose of removing moisture from the absorbent body, it is possible to use any known method that does not destroy the absorbent body. It is possible here, in particular, to use mechanical pressing methods because the absorbent body is either already resistant to mechanical pressure in any case or can be made resistant with low outlay. Furthermore, the absorbent body may be configured as a cost-effective exchangeable part so that wear of the absorbent-body material is acceptable. Mechanical pressing methods have the advantage that they can be implemented with straightforward measures and remove moisture or liquid with low energy consumption. It is also conceivable here, however, to remove moisture from the absorbent body by the use of heat and/or by dry air.

A continuous process is, advantageously used, to bring the item of clothing into contact with an absorbent body, which, then, has moisture removed from it again. It is possible here for an absorbent body to be brought into contact with an item of clothing, and have moisture removed from it, section by section. For such a purpose, it is possible to use, in particular, a circulating continuous absorbent body, the movement path of which runs from an item of clothing to a moisture-removal device and back again. For example, use may be made of a belt-like absorbent body that circulates through deflecting rollers, it being possible for the items of clothing that are to be dried to be moved between a deflecting roller and a pressure-exerting configuration, in particular, in the form of a pressure-exerting roller. If, in addition, the items of clothing are moved at the same speed as the surface of the absorbent body, it is, thus, possible to achieve the situation where the absorbent body rolls on the item of clothing, this avoiding relative movement between the absorbent body and the item of clothing and, thus, abrasion of the item of clothing.

In accordance with a further mode of the invention, the absorbent body is provided with a plurality of sections and individual sections of the absorbent body are successively brought into contact with the item of clothing, separating the section from the item of clothing, and removing moisture from the item of clothing.

In accordance with an added mode of the invention, the absorbent body is provided as a continuous strand and the absorbent body is circulated to successively move the individual sections of the absorbent body to the item of clothing and to a configuration for removing moisture from a section of the absorbent body.

In accordance with an additional mode of the invention, moisture is removed from the absorbent body by squeezing.

In accordance with yet another mode of the invention, the at least one absorbent body is rolled on the item of clothing.

It is also possible to provide an absorbent body that is large enough to be used, section-by-section, to remove moisture from all the items of clothing in a batch. Those sections of the absorbent body that are used, or brought into contact with an item of clothing, are moved to a collecting location. Following removal of moisture from the last item of clothing in the batch, the absorbent body can be dried as a whole or section-by-section. In the case of this method, a very high level of moisture-removal action can be achieved for all the items of clothing in the batch because it is always possible for a completely dry absorbent-body section to be brought into contact with an item of clothing. It is also possible, here, for the absorbent body to be dried slowly in the ambient air until the configuration is next used. For such a purpose, it is possible for a connection between the collecting location of the absorbent body and the exterior to be open or for the collecting area to be ventilated.

In accordance with yet a further mode of the invention, the item of clothing can be brought into contact with an absorbent body from different sides. It is, thus, possible for a larger surface area of the item of clothing to be brought into contact with absorbent bodies and, consequently, for the moisture-removal action to be improved.

To bring the item of clothing and the absorbent body into contact with one another, it is also possible for the item of clothing to be pressed against the absorbent body by a gas jet, in particular, an air jet. This avoids impressions of solid objects on the item of clothing.

In accordance with yet an added mode of the invention, the item of clothing is subjected to action of at least one gas jet acting transversely to a surface of the item of clothing following contact with the absorbent body.

Following the moisture removal with the aid of the absorbent body, the item of clothing may be subjected to the action of gas jets or compressed-air jets to be pressed. Using a gas jet, which is, preferably, an air jet and exerts a force on the item of clothing that is to be pressed, makes it possible to achieve a pressing action with low outlay, this pressing action, in addition, having no adverse effects on the item of clothing. The gas jet can push the fabric of the item of clothing in at certain locations or subject the entire item of clothing to a tensile force. As a result, the item is tensioned. As such, any creases that may be present are pressed. This pressing action of the gas jet may be enhanced by the fabric of the item of clothing being relieved of tensioning prior to the pressing operation or at the beginning of the pressing operation, by the fabric of the item of clothing being dampened and heated. For such a purpose, water vapor may be mixed in with the gas jet and, in this way, directed onto the fabric. Furthermore, the item of clothing can be sprinkled with water, it being possible for the water to be sprinkled by the nozzle that directs the gas jet against the item of clothing or by a dedicated nozzle, which is not used for producing the gas jet.

The at least one gas jet necessarily subjects the item of clothing to a force. The item of clothing may, thus, be disadvantageously moved and possibly creased in the process.

This can be prevented, for example, by using a gas jet that, although having a high outflow speed, has a small diameter. As a result, the item of clothing is not subjected to any large force and significantly changed in position, by the gas jet, although, over a small region of the item of clothing, it is possible to achieve a high level of tensioning action for the fabric and, thus, a good pressing action. Provision may be made here, in the case of hanging items of clothing, for the deflection on account of the gas jet to be compensated for at least in part by drawing the measures for hanging the item of clothing some way in the direction of the nozzle out of which the gas jet flows.

The item of clothing is, advantageously, supported as it is subjected to the action of the gas jet. This can prevent the item of clothing from being moved by the force of the gas jet. It is, thus, also possible to use a stronger gas jet and, thus, to achieve a better pressing action. The support may be provided by fixed supports, for example, at least one supporting surface. If the item of clothing is moved, for example, to pass through a number of treatment stations, such supports may also be set up such that they can move along with the item of clothing. For example, use may be made of at least one supporting roller that is mounted in a rotatable manner about an axis that is oriented at least substantially perpendicularly to the movement direction of the item of clothing.

In accordance with yet an additional mode of the invention, the item of clothing is supported by a gas jet. In such an embodiment, the item of clothing is subjected to the action of at least one gas jet from both sides. This makes it possible to avoid impressions in the fabric that can occur in the case of solid supports. Furthermore, the pressing action is enhanced because a force is exerted by a gas jet from both sides.

The gas jets acting from both sides may be coordinated with one another, in particular, such that that section of the item of clothing that is located therebetween is deformed in a certain way to achieve a good pressing result. For such a purpose, the force exerted by the gas jets from both sides may be distributed over a certain surface area in each case with a non-uniform force distribution. The force distributions over the surfaces on the two sides may be set differently. As a result, in one section of the item of clothing, the force exerted on the section from one side is greater than the force exerted from the other, second side and, in an adjacent section, the force exerted from the second side is predominant. The item of clothing may, thus, be deformed in a defined manner, resulting in an assumption of, for example, an undulating form or raised sections form in the item of clothing on one side and the other. For example, it is possible to use, from one side, a gas jet that widens conically and is internally hollow. As a result, it exerts a force in an annular region on the surface of the item of clothing, and, from the other side, a gas jet that produces a force exclusively in a small punctiform or circular region, the punctiform or circular region being located within the annular region of the force exerted from the opposite side. As a result, the fabric of the item of clothing is tensioned and pressed between the annular region and the punctiform or circular region located therein. Instead of a punctiform or circular surface pressure from one gas jet, it is also possible to select a substantially linear surface pressure. It is generally possible, with the action of force in adjacent regions in different directions, for the fabric to be tensioned and pressed in these regions.

The forces acting from both sides may be coordinated such that the item of clothing is retained in a certain local region and, in particular, is prevented from coming into undesirable contact with other parts. As a result, it is possible to prevent soiling or creasing. Because the force of a gas jet used decreases as the distance of the gas jet from the nozzle increases, the configuration, the orientation, and the outflow characteristics of mutually opposite nozzles directed toward one another can create a regulating system that tries to retain the items of clothing at a certain location between the nozzles.

Provision may also be made here, however, for the location of the item of clothing or of a section of the item of clothing to be detected and for the location detected to be used as an input variable for a regulating device by way of which the gas jets acting on the item of clothing from both sides are regulated such that the item of clothing or the section of the item of clothing is always at a predetermined desired location or desired location region. The location may be detected by light barriers or reflected-light barriers, it also being possible to use other methods of measuring distance or detecting location, for example, by ultrasound.

By virtue of the interaction of the forces exerted on the item of clothing from both sides and of the force distribution over the surface, it is possible for fabric of the item of clothing to be tensioned firmly, but without suffering any adverse effects, and, thus, for a good pressing action to be achieved. It is possible here for the force distribution and/or the overall force exerted from the individual sides to be changed over time. As a result, it is possible to achieve changing deformation that may have an advantageous effect on the pressing operation.

During pressing, the gas jet for pressing the item of clothing may contain, in the first instance, heated air, and, then, initially substantially dry and heated air and, then, substantially dry and non-heated air. The hot air used at the beginning may be humidified to facilitate pressing. By the hot and dry air that is, then, used, the item of clothing is dried and, finally, cooled with cold air to reduce susceptibility to creases.

It is possible to change the outflow speed, the volume flow, and/or the directional distribution of the gas jet during pressing by a gas jet.

With the objects of the invention in view, there is also provided a method of removing moisture from items of clothing, including the steps of bringing an item of clothing into contact with at least one absorbent body in the form of a continuous strand, made of an absorbent material and having a plurality of sections, circulating the absorbent body to successively move individual sections of the absorbent body into contact with the item of clothing and to a configuration for removing moisture from a section of the absorbent body, separating the section from the item of clothing, subjecting the item of clothing to action of at least one gas jet acting transversely to a surface of the item of clothing following contact with the absorbent body, and removing moisture from the absorbent body following contact with the item of clothing.

With the objects of the invention in view, there is also provided a configuration for removing moisture from items of clothing, including at least one absorbent body of an absorbent material and a contacting device adapted to contact an item of clothing with the at least one absorbent body and to separate the item of clothing from the at least one absorbent body.

In accordance with again another feature of the invention, the absorbent body is of a microfiber material.

In accordance with again a further feature of the invention, there is provided a transporting device moving a plurality of items of clothing successively in a direction of the at least one absorbent body and away therefrom.

In accordance with a concomitant feature of the invention, the contacting device has a pressure-exerting roller spaced apart from the at least one absorbent body and the transporting device moves the items of clothing between the at least one absorbent body and the pressure-exerting roller.

Other features that are considered as characteristic for the invention are set forth in the appended claims.

Although the invention is illustrated and described herein as embodied in a method and configuration for removing moisture from items of clothing, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
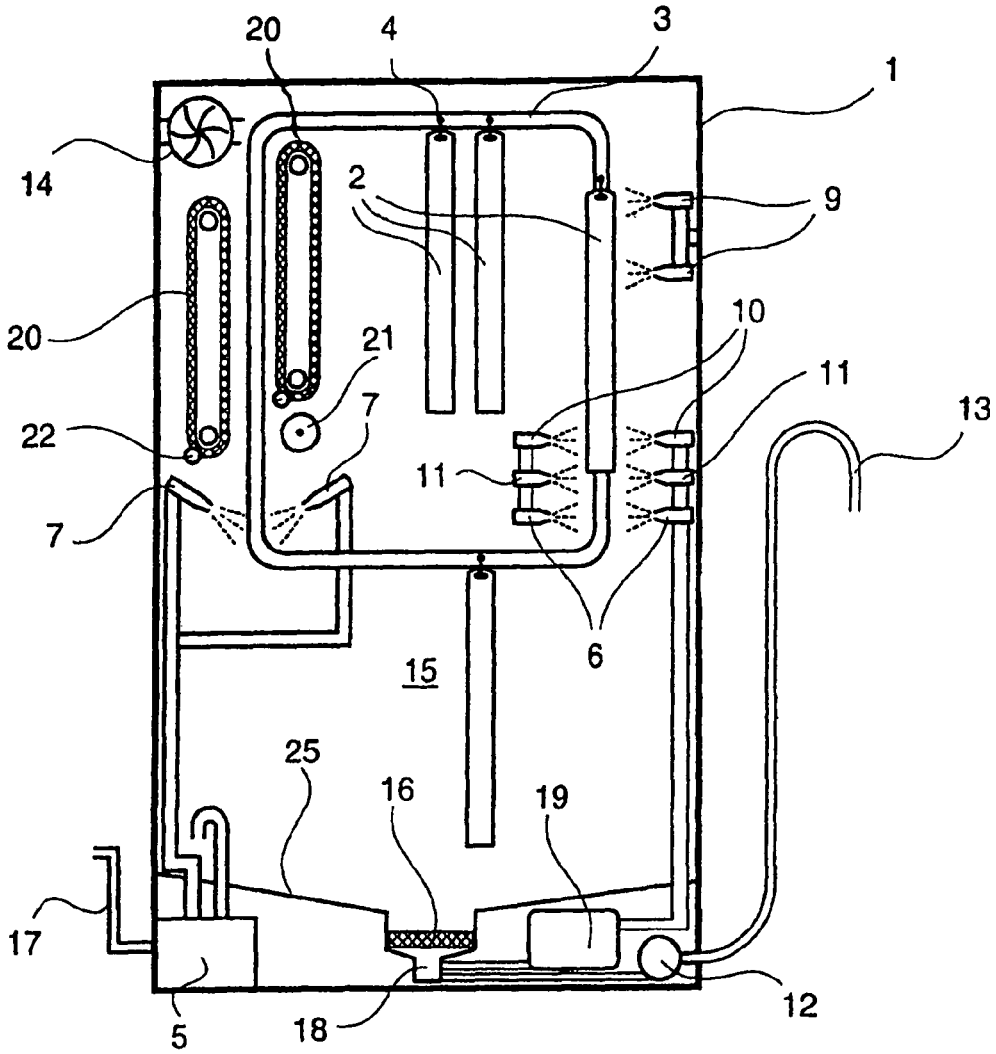
FIG. 1 is a diagrammatic cross-sectional view of one embodiment of a configuration according to the invention for pressing items of clothing.

Referring now to the figures of the drawings in detail and first, particularly to FIG. 1 thereof, there is shown a configuration for washing, removing moisture from, and pressing all types of items of clothing, such as jackets, shirts, trousers, etc., having a cuboidal or cabinet-like housing 1 that serves for accommodating the items of clothing 2 that are to be pressed. Disposed within the housing 1, on two opposite inner walls, is in each case one continuous transporting belt 3 that is mounted in a circulating manner, FIG. 1 showing one transporting belt 3, in plan view. The two transporting belts 3 can be driven at the same circulatory speed and in the same, clockwise direction. Disposed between the transporting belts 3 are non-illustrated connecting struts on which are fastened hanging configurations 4, on which the items of clothing 2 that are to be pressed are hung. The hanging configurations 4 are substantially in the form of a clothes hanger. As a result, all types of items of clothing can be hung thereon.

The transporting belts 3 are disposed in the top region of the housing 1 and are in the form of a square. As a result, the items of clothing 2 can be moved upward on the left-hand side, to the right at the top, downward on the right-hand side and to the left at the bottom. At the bottom of the left-hand side wall of the housing 1, two mutually opposite compressed-air nozzles 7 are disposed such that the items of clothing can be moved upward by the transporting belts 3 through the interspace between the compressed-air nozzles 7. The compressed-air nozzles 7 are connected to a generator 5, which has a fan and can produce air streams at different temperatures and different pressures. The generator 5 has an air inlet within the housing 1 and an air inlet 17 outside the housing 1, which can take in fresh air.

Disposed above the compressed-air nozzles 7 is a moisture-absorbing nonwoven 20 that is mounted, by two deflecting rollers, in the vicinity of the inner wall such that it can be driven like a conveying belt and moves parallel to the movement path of the items of clothing 2. The moisture-absorbing nonwoven 20 is of a highly absorbent material and is driven at the same speed as the items of clothing 2. As a result, the respectively inner section moves upward together with the items of clothing 2. Disposed on that side of the transporting belt 3 that is located opposite to the moisture-absorbing nonwoven 20 is a pressure-exerting roller 21 that is provided with a compliant coating. The distance between the pressure-exerting roller 21 and the moisture-absorbing nonwoven 20 can be changed. As a result, it is possible either to compress the items of clothing 2 between the pressure-exerting roller 21 and the moisture-absorbing nonwoven 20 as they move through or to move the items of clothing 2 through the moisture-absorbing nonwoven 20 without contact. Provided at the bottom deflecting roller of the moisture-absorbing nonwoven 20 is a squeezing-out roller 22, which is spaced apart from the bottom deflecting roller by such a small distance that the moisture-absorbing nonwoven 20 is compressed to a pronounced extent between the bottom deflecting roller and the squeezing-out roller 22 and, as such, liquid contained in the moisture-absorbing nonwoven 20 is squeezed out therefrom.

Furthermore, the bottom part of the housing 1 contains a sump 18 in a false floor 25, this being disposed at the bottom within the housing 1 and being formed such that all the liquid from the top part of the housing 1 collects at the bottom in the sump 18, in which a lint filter 16 is disposed. The false floor 25, furthermore, has the function of dividing off a dry space in which the generator 5 is accommodated. Also disposed in the dry space is a discharge pump 12, of which the inlet opens out into the sump 18 and the outlet 13 leads outward and can be connected to a waste-water connection, in particular, a household one.

Also disposed in the dry space, beneath the false floor 25, is a washing configuration 19, which is connected to the sump 18 and a non-illustrated clean-water feed and has a liquid pump and a heater. The washing configuration 19 is set up such that it can remove liquid either from the clean-water feed or from the sump 18 and can pass it on to different nozzles, it being possible for the liquid to be heated and, in particular, for liquid removed from the clean-water feed to be evaporated. Also provided in the washing configuration is a dispensing configuration, by which detergent can be dispensed into the housing 1.

Connected to this washing configuration 19 are wetting nozzles 9, washing nozzles 10, rinsing nozzles 11 and hot-steam nozzles 6, these being disposed on the right-hand side of the housing 1. The wetting nozzles 9 are supplied with clean water and serve for wetting dry items of clothing 2. The washing nozzles 10 are supplied with, in particular, heated washing liquid, which is circulated, in particular, the sump 18, and serve for washing the items of clothing 2. The rinsing nozzles 11 are supplied with cold clean water and serve for rinsing the washing liquid out of the items of clothing 2. The hot-steam nozzles 6 are supplied with heated water vapor obtained from clean water and serve for steaming the items of clothing 2.

Figure 2:
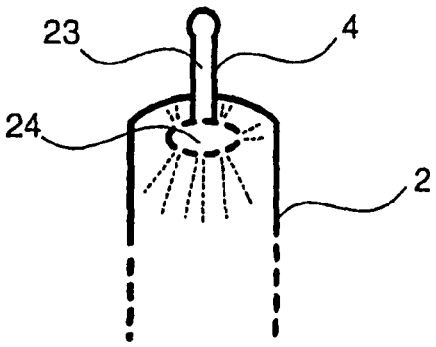
FIG. 2 is a fragmentary, cross-sectional view through a side of a configuration for receiving items of clothing for use in the pressing configuration according to FIG. 1.

FIG. 2 illustrates in section, by way of example, a hanging configuration 4 that has a hollow connecting section 23 and a hanger section 24 that is connected to the latter at the bottom, extends perpendicularly to the plane of the drawing and has a length that corresponds substantially to the width of an item of clothing 2. The hanger section 24 is hollow and has openings distributed over its periphery. The hanging configurations 4 can be connected to the generator 5 or the washing configuration 19 through non-illustrated devices such that the interior of the connecting sections 23 and of the hanger sections 24, like the hot-air nozzles 6, can be supplied with hot air, washing liquid, rinsing liquid, or steam.

Using the configuration according to the invention that is illustrated in FIG. 1, items of clothing 2 can be first of all washed and dried and, finally, pressed, there being no need for the items of clothing 2 to be removed from the configuration. In the first instance, the items of clothing 2 are hung on the hanging configurations 4. For such a purpose, it is possible for the hanging configurations 4 to be removed from the housing 1, for the items of clothing 2 to be hung on the hanging configurations 4 and for these, then, to be hung in the housing 1 again on the connecting struts between the transporting belts 3. Once the housing 1 has been closed, the wash cycle is initiated. For such a purpose, the transporting belts 3 are set in motion to move the items of clothing 2 through the housing in the clockwise direction. In the first instance, the items of clothing 2 are wetted with clean water by the wetting nozzles 9. Thereafter, the items of clothing 2 are moved on to the washing nozzles 10, by which they are sprayed with washing liquid, which is produced in the washing configuration 19 by virtue of detergent being dispensed into clean water. For such a purpose, the clean water is directed through a non-illustrated dispensing device, into which detergent can be introduced in powder and/or liquid form. The detergent, here, is dispensed into the housing 1.

As soon as there is a desired level of liquid in the housing 1 or a certain predetermined quantity of liquid has run in, the washing configuration 19 stops the feed of clean water and begins removing water from the sump 18 and directing it to the liquid nozzles 8, the water being heated to a desired temperature. The water, which, in the meantime, has been mixed with the detergent, is, thus, circulated as washing liquid and can also be sprayed from the inside, through the hanging configurations 4, onto the items of clothing 2. In this step, dirt is rinsed out of the items of clothing 2.

Then, in a rinsing phase, the washing liquid is pumped out, by the discharge pump 12, into a wastewater connection. Thereafter, the items of clothing 2 are rinsed to remove the washing liquid from them. For such a purpose, in a number of rinse cycles, clean water is pumped to the rinsing nozzles 11 and the water, together with the rinsed-out washing liquid, is pumped out by the discharge pump 12. The rinsing action is enhanced, in that, at the end of each rinse cycle, the liquid feed to the rinsing nozzles 11 is interrupted and the compressed-air nozzles 7 are supplied with compressed air. When the items of clothing 2 are moved between the compressed-air nozzles 7, they are compressed by the compressed-air jets. As a result, the rinsing liquid is forced out of them. As such, fewer residues of the washing liquid or contaminants remain following a rinse cycle. As a result, a smaller number of rinse cycles and less rinsing liquid is necessary. The air directed to the compressed-air nozzles 7 may also be heated here, as a result of which, the liquid absorbed by the items of clothing 2 flows out more easily and it is possible to enhance the water removal by compressed air at the end of the rinse cycles. So that a significant amount of liquid is squeezed out of the items of clothing, the compressed-air nozzles 7 are subjected to a very high pressure.

Following the last rinse cycle, the items of clothing 2 have further moisture removed from them mechanically by the moisture-absorbing nonwoven 20. For such a purpose, the distance between the moisture-absorbing nonwoven 20 and the pressure-exerting roller 21 is reduced to the extent where an item of clothing 2 moving through therebetween is forced against the moisture-absorbing nonwoven 20 by the pressure-exerting roller 21. In the process, the highly absorbent material of the moisture-absorbing nonwoven 20 extracts further moisture from the item of clothing 2. The moisture absorbed by the moisture-absorbing nonwoven 20 is squeezed out again between the bottom deflecting roller and the squeezing-out roller 22. As a result, that part of the liquid-absorbing nonwoven 20 that has just come into contact with an item of clothing 2 always contains as little moisture as possible so that as much liquid as possible is extracted from the item of clothing 2. This purely mechanical way of removing moisture does not require any heat, which disadvantageously requires a very large amount of energy to produce. As a result, with the aid of the moisture-absorbing nonwoven 20, the moisture content of the items of clothing 2 can be reduced with particularly low energy-related outlay.

Furthermore, using this way of removing moisture, on account of the absorbing action of the moisture-absorbing nonwoven 20, a large amount of moisture can be extracted from the items of clothing 2 even with just a low contact pressure. As a result, the items of clothing 2 are not creased and, nevertheless, have moisture removed from them to a great extent. The contact pressure can be adjusted by changing the distance between the pressure-exerting roller 21 and the moisture-absorbing nonwoven 20, particularly, in dependence on the fabric and thickness of the items of clothing 2.

The preliminary removal of moisture by the moisture-absorbing nonwoven 20 is followed by the drying and pressing step. The pressing, advantageously, takes place with a defined level of moisture in the items of clothing 2. If the items of clothing have already had sufficient amounts of moisture removed from them by the moisture-absorbing nonwoven 20, the items of clothing 2 may be pressed immediately following the preliminary removal of moisture by mechanical measures.

If the preliminary removal of moisture by mechanical measures was not sufficient, the items of clothing 2 are dried to the suitable level of moisture, prior to pressing, with warm or hot air from the compressed-air nozzles 7. For such a purpose, low-pressure heated air is directed to the compressed-air nozzles 7. At the same time, the rear wall 15 of the housing is cooled with clean water from the clean-water connection. As such, the moisture extracted from the items of clothing 2 condenses on the rear wall 15 and runs into the sump 18, from which it can be pumped out, together with the cooling water for the rear wall 15, by the discharge pump 12. There is air circulation within the housing 1 in this case, for which purpose the generator 5 takes in the air within the housing 1.

It is also possible for the items of clothing 2 to have moisture removed from them, until the desired level of moisture is reached, by the ventilation principle, in that, by a fan 14, air is constantly blown outward from the interior of the housing 1. As such, the moisture extracted from the items of clothing 2 is led outward, the generator 5 having to take in the air from the outside. This method, however, requires the configuration to be set up in a sufficiently ventilated area in order to discharge the moisture that is led outward. The two possibilities, of either condensing the moisture in the configuration and pumping it out or of leading it outward, allow an operator to decide between the two variants in accordance with the respective conditions. Condensing the moisture in the configuration has the advantage that the set-up area need not be ventilated. As a result, for example, in winter, there is, advantageously, no loss of energy for heating the set-up area. In summer, in contrast, it is possible to select the ventilation variant, which does not require any clean water for cooling the rear wall 15 and requires less energy for heating the dry air.

Pressing takes place by virtue of the items of clothing being subjected to the action of hot-steam from the hot-steam nozzles 6. As a result, the fabric of the items of clothing 2 is heated and relieved of tensioning. The items of clothing 2 are, then, guided between the two compressed-air nozzles 7. As a result of the compressed air passing out of the compressed-air nozzles 7, the fabric of the items of clothing 2 is tensioned and pressed, the pressing operation and the compressed-air jets used corresponding to the previous exemplary embodiment. Pressing takes place by virtue of the force to which the items of clothing are subjected by the compressed-air jets from the compressed-air nozzles 7. This force may be adjusted, to produce the desired action, by the pressure of the air directed to the compressed-air nozzles 7. In particular, the force is adjusted such that the items of clothing 2 do not flap about; rather, that section of an item of clothing 2 that is respectively located between the compressed-air nozzles 7 are held taut. The compressed air used in the pressing step has a lower pressure than the compressed air that is used for removing moisture at the end of the washing phase. During pressing, an excessively high air pressure may be disadvantageous if the items of clothing 2 are, thus, caused to flap about or crease.

It is possible, for example, for the two compressed-air nozzles 7, during pressing, to subject the items of clothing to differently distributed surface-area forces. As a result, the forces acting from both sides on a certain part of an item of clothing 2 do not cancel one another out. It is advantageous for the surface-area force profiles of the forces exerted by the two compressed-air nozzles 7 to complement one another. As a result, for example, in the regions in which a high surface-area force is produced by the left-hand compressed-air nozzle 7, a low surface-area force is produced by the right-hand compressed-air nozzle 7, and vice-versa. The forces, here, are such that the items of clothing are retained approximately centrally between the two compressed-air nozzles 7.

In this way, an item of clothing 2 may be subjected, by compressed air, to tensioning forces that tension, and, thus, press, individual fabric sections of the item of clothing 2. This operation is repeated each time a certain item of clothing 2 is guided between the two compressed-air nozzles 7. During this operation, steam may continue to be directed onto the items of clothing by the hot-steam nozzles 6. It should be ensured here that the steam is only expelled at low pressure so as to not result in the items of clothing 2 flapping about and/or creasing. The items of clothing 2 are dried further during this pressing operation, the moisture being extracted, as has been described above, by condensing on the cooled rear wall 15 and being pumped out by the discharge pump 12 or being blown outward by the fan 14.

Following a certain period of time, the discharge of hot-steam from the hot-steam nozzles 6 is stopped. The items of clothing are, then, only subjected to the action of hot compressed air from the compressed-air nozzles 7 to finish drying them during pressing. As soon as the desired degree of dryness has been reached, the items of clothing are only subjected to the action of cold air to cool them, as in the previous exemplary embodiment. Thereafter, the items of clothing 2 can be removed from the housing 1.

As soon as drying of the items of clothing 2 has been finished, the items of clothing are moved further in the housing 1, although only cold air is blown in through the compressed-air nozzles 7. As a result, the pressed items of clothing 2 are cooled and become less susceptible to creasing because the fabric creases more easily when hot. Furthermore, the situation where an operator burns himself/herself on hot parts within the housing 1 is prevented. Following cooling of the items of clothing 2 and/or of the configuration, the items of clothing 2 can be removed.

For the items of clothing 2 to be pressed without this operation being preceded by a wash cycle, the items of clothing can be dampened with a small amount of clean water from the wetting nozzles 9. As a result, the fabric of the items of clothing 2 is relieved of tensioning. Thereafter, the items of clothing 2 can be pressed and dried as described above. The hot-steam nozzles 6 also make it possible for the items of clothing 2 to be pressed without being soaked beforehand. For such a purpose, items of clothing 2 that have, for example, already been washed and dried may be steamed in the configuration and, then, pressed and dried as described above.

Furthermore, it is also possible for the items of clothing 2 to be pressed without steaming by the hot-steam nozzles. This is possible, in particular, if the items of clothing 2 have been washed beforehand and, following the preliminary removal of moisture, contain a certain residual level of moisture. In such a case, heated compressed air is, advantageously, directed to the compressed-air nozzles 7 to heat the items of clothing 2 and, thus, facilitate pressing.

We claim:

1. An arrangement for removing moisture from items of clothing, comprising:

a plurality of absorbent bodies;

means forming a contact path along which an absorbent body and a first item of clothing are in contact with one another during a moisture transfer run, the contact path having an entry, an exit, and an extent extending between the contact path entry and the contact path exit;

means for disengaging a respective absorbent body and the first item of clothing from contact with one another at the contact path exit, the respective absorbent body absorbing moisture from the first item of clothing as the respective absorbent body and the first item of clothing are in contact with one another along the contact path extent such that the level of moisture retained by the respective absorbent body is greater at the contact path exit than at the contact path entry;

means for reducing the level of moisture retained by a respective absorbent body to dispose the respective absorbent body at a level of moisture at the contact path entry that is lower than the level of moisture retained by the respective absorbent body at the contact path exit; and means for advancing each respective absorbent body and the first item of clothing along the contact path such that the first instance at which each respective absorbent body is in moisture absorbing contact with the first item of clothing occurs at the contact path entry, the respective absorbent body and the first item of clothing are advanced along the contact path to permit the respective absorbent body to absorb moisture from the first item of clothing, thereby leading to an increase in the level of moisture retained by the respective absorbent body as the respective absorbent body and the first item of clothing reach the contact path exit, and the respective absorbent body and the first item of clothing are advanced out of moisture transferring contact with one another at the contact path exit, the means for advancing being operable to dispose each respective absorbent body at the contact path entry for a subsequent advancing movement of the absorbent body in contact with a second item of clothing during a subsequent moisture transfer run along the contact path, the means for advancing and the means forming a contact path being configured such that the level of moisture retained by each respective absorbent body increases in correspondence with the advancement of the respective absorbent body and the respective item of clothing along the contact path extent, the means for advancing and the means forming a contact path operating in coordination with one another such that the plurality of absorbent bodies are successively advanced one after another into contact with a respective item of clothing along the contact path extent, whereupon, during each moisture transfer run, one of the absorbent bodies will eventually be advanced out of moisture transferring contact with the respective item of clothing at the contact path exit at a time that another one of the absorbent bodies following behind the one absorbent body has not yet completed its advancing movement in contact with the respective item of clothing.

2. The arrangement according to claim 1, wherein the absorbent bodies are trained around a first roller and a second roller for travel of the absorbent bodies in an endless travel path.

3. The arrangement according to claim 2, wherein the means for reducing the level of moisture retained by the respective absorbent body includes a squeezing out-roller disposed adjacent the endless travel path of the respective absorbent body for mechanically compressing the respective absorbent body to effect removal of moisture from the respective absorbent body.

4. The arrangement according to claim 1, wherein the plurality of absorbent bodies includes one group of absorbent bodies trained as a loop around a first roller for travel of the loop in an endless travel path and another group of absorbent bodies trained as a loop around a second roller for travel of the loop in an endless travel path, each of the loops being disposed on a respective lateral side of the contact path such that the contact path extends between the loops and the loops simultaneously contacting an item of clothing on respective opposite lateral sides thereof during advancement of the absorbent bodies and the item of clothing along the contact path.

5. The arrangement according to claim 1, wherein the contact path extends in a vertical direction and the means for advancing advances the respective item of clothing in contact with the respective absorbent body in a vertical direction.

6. The arrangement according to claim 1 and further comprising means for transversely guiding a respective item of clothing being advanced along the contact path, the transversely guiding means being operable to transversely guide a respective item of clothing in a direction transverse to the contact path toward the respective absorbent body.

7. The arrangement according to claim 1 and further comprising a gas jet acting transversely to a surface of a respective item of clothing that has traveled beyond the contact path exit.

8. The arrangement according to claim 1 and further comprising a compressed air nozzle disposed relative to the contact path to emit a stream of compressed air into contact with a respective item of clothing before the item of clothing is advanced along the contact path.

* * * * *